US006090271A

United States Patent [19]

Carpency et al.

[11] Patent Number: 6,090,271

[45] Date of Patent: Jul. 18, 2000

[54] ENHANCED OLEFIN YIELDS IN A CATALYTIC PROCESS WITH DIOLEFINS

[75] Inventors: Joseph Francis Carpency, Seabrook; Tan-Jen Chen, Kingwood, both of Tex.; Shun Chong Fung, Bridgewater, N.J.; Andrew Brennek, Sarnia, Canada

[73] Assignee: Exxon Chemical Patents Inc., Houston, Tex.

[21] Appl. No.: 08/872,808

[22] Filed: Jun. 10, 1997

[51] Int. Cl.[7] ..... C10G 11/00; C10G 11/02; C07C 4/02

[52] U.S. Cl. ..... 208/113; 208/118; 208/85; 585/650; 585/651; 585/653

[58] Field of Search ..... 208/113, 118, 208/120, 85; 585/650, 651, 653, 551

[56] References Cited

U.S. PATENT DOCUMENTS

| | | | |
|---|---|---|---|
| 2,882,244 | 4/1959 | Milton | 252/455 |
| 3,130,007 | 4/1964 | Breck | 23/113 |
| 3,216,789 | 11/1965 | Breck et al. | 23/113 |
| 3,360,587 | 12/1967 | Adams | 260/683 |
| 3,692,667 | 9/1972 | McKinney et al. | 208/120 |
| 3,702,886 | 11/1972 | Argauer et al. | 423/328 |
| 3,709,979 | 1/1973 | Chu | 423/328 |
| 3,758,400 | 9/1973 | Hampton | 208/72 |
| 3,882,243 | 5/1975 | Maeda et al. . | |
| 3,954,600 | 5/1976 | Gladrow et al. | 208/119 |
| 4,066,531 | 1/1978 | Owen et al. | 208/120 |
| 4,855,521 | 8/1989 | Avidan et al. | 585/415 |
| 5,246,568 | 9/1993 | Forbus et al. | 208/59 |
| 5,318,696 | 6/1994 | Kowalski | 208/120 |
| 5,324,419 | 6/1994 | Muldowney | 208/120 |

FOREIGN PATENT DOCUMENTS

| | | |
|---|---|---|
| 077546 | 1/1981 | Japan . |
| 1310421 | 5/1987 | U.S.S.R. . |

OTHER PUBLICATIONS

"Atlas of Zeolite Structure Types" by W. M. Meier, D. H. Olson and C. H. Baerlocher (4th edn., Butterworths/Intl. Zeolite Assc. [1966]).

*Primary Examiner*—Walter D. Griffin
*Assistant Examiner*—Tam M. Nguyen

[57] ABSTRACT

The invention provides a process for improving the conversion of a hydrocarbon feedstock to light olefins comprising mixing a hydrocarbon feedstock with a diolefin to form a mixture; and thereafter contacting the mixture with a zeolite cracking catalyst. Preferably the catalyst is contacted at a reaction temperature within the range of about 500° C. to about 750° C. and the feedstock flows at a weight hourly space velocity in the range of about 0.1 $Hr^{-1}$ WHSV to about 100 $Hr^{-1}$ WHSV. The diolefin can be a straight, branched, or cyclic hydrocarbon having at least two II bonds. Preferably diolefin is a hydrocarbon of 4 to 20 carbons.

45 Claims, No Drawings

ENHANCED OLEFIN YIELDS IN A CATALYTIC PROCESS WITH DIOLEFINS

FIELD OF THE INVENTION

The invention provides a process for increasing yields of ethylene and propylene in a catalytic process by using diolefins in the feed to a catalytic process.

BACKGROUND OF THE INVENTION

Thermal and catalytic conversion of hydrocarbons to olefins is an important industrial process producing billions of pounds of olefins each year. Because of the large volume of production, small improvements in operating efficiency translate into significant profits. Catalysts play an important role in more selective conversion of hydrocarbons to olefins.

Particularly important catalysts are found among the natural and synthetic zeolites. Zeolites are complex crystalline aluminosilicates which form a network of $AlO_4$ and $SiO_4$ tetrahedra linked by shared oxygen atoms. The negative charge of the tetrahedra is balanced by the inclusion of protons or cations such as alkali or alkaline earth metal ions. The interstitial spaces or channels formed by the crystalline network enable zeolites to be used as molecular sieves in separation processes. The ability of zeolites to adsorb materials also enables them to be used in catalysis. There are a large number of both natural and synthetic zeolitic structures. The wide breadth of such structures may be understood by considering the work "Atlas of Zeolite Structure Types" by W. M. Meier, D. H. Olson and C. H. Baerlocher (4th edn., Butterworths/Intl. Zeolite Assoc. [1996]). Catalysts containing zeolite have been found to be active in cracking hydrocarbons to ethylene and propylene, the prime olefins. Of particular interest are the ZSM-5 zeolite described and claimed in U.S. Pat. No. 3,702,886, and ZSM-11 described in U.S. Pat. No. 3,709,979, and the numerous variations on these catalysts disclosed and claimed in later patents.

There is a constant need for increasing yields in conversion of hydrocarbons to ethylene and propylene, and especially for increasing the yields of propylene relative to ethylene in catalytic hydrocarbon processing. As global petroleum supplies are depleted, the need for improved yield will become increasingly important. The prior art has not filled the need for improved yield, although there have been many attempts. The present invention provides improved conversion of hydrocarbons to light olefins, and especially propylene by deliberately providing diolefins in a hydrocarbon feed subjected to catalytic conversion. As one can see, the prior art teaches away from the claimed invention, showing at best maintenance of ethylene yield.

Adams, U.S. Pat. No. 3,360,587, teaches separation of ethylene from acetylene, butadiene and other contaminants contained in the effluent from the thermal cracking of saturated hydrocarbons by introduction of the effluent into the reaction stream of a heavy oil catalytic cracking process, with the overall objective of increasing gasoline boiling components. Adams reports the recovery of the ethylene fraction with reduced acetylene and butadiene content, but shows a decrease in conversion to propylene. Also Adams did not use modern zeolite catalysts, especially those of the ZSM-5 or ZSM-11 types nor did Adams observe a significant increased yield of ethylene over separate thermal and catalytic cracking steps. Adams' reported yield comparison showed 80.9 mols (2263 lb.) of ethylene for the separate streams compared to 81.8 mols. (2295 lb.) of ethylene (32 lb., 1.3% net increase) from the stream having butadiene and acetylene combined with the heavy oil feed in the catalytic cracking operation. Adams viewed the result as conserving the ethylene, not an enhanced yield (See Adams col. 7 lines 24–26 ". . . obviously indicating that none of the ethylene from the pyrolysis effluent is 'lost' in the catalytic cracking zone."). Adams did not observe that the addition of diolefins to a feed stream could substantially enhance conversion to light olefins including propylene.

Catalyst stability is an important factor in overall yield. In refinery operations crude oil is fractionated to produce feedstock streams for further treatments. The streams so produced are often referred to as "virgin" streams, when used without further processing. Because demand for the lower molecular weight hydrocarbons exceeds the demand for high molecular weight streams, many higher molecular weight fractions are cracked to lower molecular weight streams by thermal or catalytic cracking. These "cracked" streams share the boiling range and major components with "virgin" streams of the same designation as for example "light cat naphtha" (LCN) indicating a catalyst cracked naphtha as compared to "light virgin naphtha" (LVN). While these streams have similar boiling ranges and include some of the same components, they often have quite different performance in refinery operations. For example it has long been recognized that catalyst life in zeolite cracking is substantially greater when processing LVN streams than when processing cracked streams such as LCN. On the other hand LCN streams often exhibit higher initial conversions to ethylene and propylene. The present invention provides a method for enhancing LVN yields to levels similar to those obtained with LCN, while delaying the loss of catalyst stability observed with LCN.

In summary the art continues to seek improved yield of light olefins, but the process of the present invention has not previously been recognized.

SUMMARY OF THE INVENTION

The present invention provides a process for improving the conversion of a hydrocarbon feedstock to light olefins comprising contacting a hydrocarbon feedstock containing at least one diolefin in a concentration sufficient to increase conversion of the feedstock to light olefins, with a cracking catalyst comprising an acidic zeolite. The zeolite catalyst may be a natural or synthetic zeolite, promoting the formation of light olefins from hydrocarbons. Alternatively the invention provides a process for improving the conversion of a hydrocarbon feedstock to ethylene and propylene comprising:

(1) mixing a hydrocarbon feedstock with an amount of diolefin, sufficient to improve light olefin yields, to form a mixture; and (2) contacting the mixture with a cracking catalyst comprising an acidic zeolite.

When practiced with virgin streams such as light virgin naphtha, the conversion is enhanced to levels equaling or exceeding the initial yields observed with LCN feeds while avoiding the rapid loss of catalytic activity.

DETAILED DESCRIPTION OF THE INVENTION

Definitions

"Light naphtha" means a hydrocarbon distillate fraction that is predominantly $C_5$ to $C_7$ hydrocarbons.

"Virgin naphtha or stream" means a hydrocarbon distillate fraction obtained from crude oil or natural gas without additional conversion processing.

"Cat naphtha" means a hydrocarbon distillate fraction obtained by catalytic cracking of a heavier hydrocarbon fraction.

"BTX" means a mixture containing benzene, toluene, and xylenes.

"Diolefin" as used in this application means an unsaturated hydrocarbon having at least two II bonds between carbon atoms. While normally a diolefin will have two double bonds, a molecule with additional double bonds or with one or more triple bond may also function as a diolefin for purposes of this invention. The mere addition of a double or triple bond to a diene does not defeat the improvement of the invention. At the present time the vast majority of possible feedstocks are compounds having only two double bonds. However unsaturated hydrocarbons such as n-1,3,5 hexatriene or n-1,4,6-heptatriene or propyne also meet the requirements to function as a "diolefin" in the context of this invention.

"Light olefin" means ethylene, propylene, and mixtures thereof.

"Improved conversion" means producing an increase in production that is at least 1.5% or greater light olefin yield over cracking the same feedstock under the same conditions with the same catalyst.

"Hydrocarbon feedstock" means a hydrocarbon stream comprising one or more hydrocarbons of 2 or more carbon atoms to be broken into fragments that form light olefins among other products.

"Mixing a hydrocarbon feedstock with a diolefin" means either physically combining a plurality of hydrocarbon streams to form a blended or combined stream or adjusting hydrocarbon processing equipment to produce a feedstock comprising the desired blend of hydrocarbons and diolefin.

Reaction Conditions and Catalysts

Substantial amounts of ethylene and propylene can be produced by cracking hydrocarbon feedstocks such as light cat naphtha (LCN) or light virgin naphtha (LVN) over zeolite containing catalysts particularly those of the ZSM-5 group. The present invention provides a method for enhancing ethylene and propylene yields which comprises mixing a feed stream containing at least one diolefin with a hydrocarbon feed stream. Preferably the feed stream is a naphtha boiling range stream such as LCN or LVN or blends of these streams with other hydrocarbon streams.

Suitable zeolites for use as the cracking catalyst are typically in the acid form of the naturally occurring or synthetic crystalline zeolites, especially those having a silica-alumina molar ratio within the range of about 2.0:1 to 2000:1. In general, any zeolite cracking higher hydrocarbons to light olefins having an improved conversion by the addition of a diolefin to its feedstock is suitable for use in the process. By employing the simple bench test described below, one skilled in the art can quickly determine whether a catalyst displays improved conversion on addition of diolefin to the feedstock to be cracked by a particular catalyst.

Examples of zeolites useful in the claimed process include gallium silicate, zeolite beta, zeolite rho, ZK5, titanosilicate; ferrosilicate; borosilicate; zeolites designated by the Linde Division of Union Carbide by the letter of X, Y, A, L (these zeolites are described in U.S. Pat. Nos. 2,882,244; 3,130,007; 3,882,243; and 3,216,789, respectively); naturally occurring crystalline zeolite such as faujasite, chabazite, erionite, mazzite, mordenite, offretite, gmelinite, analcite, etc., and ZSM-5 (described in U.S. Pat. No. 3,702,886).

Preferably the zeolite catalyst is selected from the group consisting of faujasite, chabazite, erionite, mordenite, offretite, gmelinite, analcite, ferrierite, heulandite, mazzite, phillipsite, ZSM-5, ZSM-11, ZSM-22, ZSM-25, gallium silicate zeolite, zeolite beta, zeolite rho, ZK5, titanosilicate, zeolites having a silica /alumina molar ratio within the range of about 2.0:1 to 2000:1, ferrosilicate; and borosilicate.

ZSM-5 zeolite is especially favored. Preparation of suitable zeolite containing catalysts may be carried out as described in the preceding references, and other numerous additional references known to those skilled in the art. Many suitable zeolites may be purchased from commercial suppliers well known to those skilled in the art.

The cracking procedure can be carried out with any conventional reactor equipment, fixed bed, moving bed, fluidized bed, such as a riser or dense fluid bed system, or a stationary fluid bed system and a hydrocarbon feed stream. Although the examples below demonstrate a fixed bed bench scale system, it is contemplated that in the practice of the invention, a preferred embodiment would be a circulating fluidized bed with provisions for continuous catalyst regeneration. Preferably the catalyst is contacted at a temperature within the range of 500° C. to 750° C.; more preferably in the range of 550° C. to 700° C.; most preferably in the range of 575° C. to 625° C. The process is preferably carried out at a weight hourly space velocity (WHSV) in the range of 0.1 $Hr^{-1}$ WHSV to 100 $Hr^{-1}$ WHSV, more preferably in the range of 1 $Hr^{-1}$ WHSV to 50 $Hr^{-1}$ WHSV most preferably in the range of 1 $Hr^{-1}$ WHSV to 30 $Hr^{-1}$ WHSV.

Examples of hydrocarbon streams which may be used to obtain high yields of light olefins include steam cracked naphtha, light cat cracked naphtha, light virgin naphtha, butenes, pentylenes, and coker naphtha. A preferred feedstock is light cat naphtha (LCN) or light virgin naphtha (LVN).

The diolefin component may be one or more straight, branched or cyclic, optionally substituted, hydrocarbons of two or more carbon atoms having at least two II bonds, preferably from two to 20 carbon atoms; more preferably from two to 10 carbons, most preferably four to ten carbons. The double bonds may be conjugated as in 1, 3 butadiene or unconjugated as in n-1, 4-pentadiene. One or more of the hydrocarbon hydrogens may be replaced so long as the resulting substituted hydrocarbon does not substantially decrease the activity of the catalyst. The percentage by weight of diolefins will be a quantity sufficient to produce an increase in light olefin production. The simple bench test described below will permit determination of the optimum percentage for any particular diolefin or diolefin mixture. Normally the diolefin will function in the range of 2 to 50 percent and preferably in the range of 10 to 20 percent. However, some diolefin mixtures will likely function effectively to increase light olefin production in a hydrocarbon stream when present outside these ranges.

Many zeolite catalysts are of high activity and may be employed in riser type fluidized catalytic cracking (FCC) operations allowing the continuous regeneration of catalyst during operation of the unit. Such operations typically use catalyst to oil ratios of 5–10 to one. In contrast, the less active zeolites are often used in catalyst ratios of 200 to 4000 to one. For these high catalyst to oil ratios a dense catalyst bed such as a packed bed, a stationary fluid bed or moving bed is required. Because coke builds up on the catalyst surfaces, such units must be taken off line periodically for catalyst regeneration. Thus LCN streams having a shorter useful catalyst life suffer an operational disadvantage, even though yielding higher initial yields of light olefins. However, lower production in LVN, due to lower conversion to light olefins is a penalty tending to offset the longer catalyst life observed with virgin streams. By adding diolefins to LVN according to this invention one can combine the advantages of the high conversion of LCN to light olefins with the catalytic stability of LVN.

EXAMPLE 1

A series of runs in a small bench reactor was conducted on a light cat naphtha spiked with 1,4-cyclohexadiene or 1,5-hexadiene respectively. Similar runs were made with the diolefin model compounds alone, and a control run was made with the unspiked LCN. All runs were conducted at 593° C., 1.2 $Hr^{-1}$ WHSV over a fixed bed packed with ZCAT40, which is a commercially available ZSM-5 catalyst from Intercat Inc. of Sea Grit, N.J. Prior to laboratory tests, ZCAT40 was steamed with 100% steam, at 816° C. and 1 atmosphere for 16 hours to age the catalyst. The effluent stream was analyzed by on-line gas chromatography. A column having a length of 60 m packed with fused silica was used for the analysis. The GC used was a dual FID Hewlette Packard Model 5880A.

Table 1 shows the results with a conjugated cyclic diolefin:

TABLE 1

1,4 Cyclohexadiene with Light Cat Naphtha

| 1,4 Cyclohexadiene in Feed, Wt % | 0.0 | 11.7 | 24.1 | 100.0 |
|---|---|---|---|---|
| Conversion, Wt % | 67.5 | 67.4 | 68.3 | 98.3 |
| Key Product Yields, Wt % | | | | |
| Ethylene | 8.4 | 10.4 | 9.0 | 0.5 |
| Propylene | 23.9 | 26.5 | 22.7 | 1.2 |
| Butenes | 10.1 | 9.3 | 8.2 | 0.4 |
| Aromatics | 21.7 | 18.8 | 26.0 | 96.1 |
| $C_1$–$C_4$ Light Saturates | 3.4 | 2.4 | 2.4 | 0.1 |

As can be seen from Table 1, ethylene yield was 8.4 wt % while propylene yield was 23.9 wt % when light cat naphtha was cracked over ZCAT40 at 593° C. Ethylene and propylene yields were negligible when 1, 4 cyclohexadiene was cracked neat over the same catalyst and conditions. Unpredictably, higher yields of ethylene and propylene are obtained when the light cat naphtha and diolefin are blended together than either feed produced alone. Unexpectedly, there is a maximum in ethylene and propylene yields at about 11.7 wt % 1, 4 cyclohexadiene in the feed in this data series. The increased light olefin yields were accompanied by decreased aromatics and light saturates yields, improving the overall value of the combined products.

Table 2 summarizes the results with a non conjugated diolefin:

TABLE 2

1,5 Hexadiene With Light Cat Naphtha

| 1,5 hexadiene in Feed, Wt % | 0.0 | 10.9 | 21.3 | 100.0 |
|---|---|---|---|---|
| Conversion, Wt % | 67.5 | 65.5 | 68.5 | 87.2 |
| Key Product Yields, Wt % | | | | |
| Ethylene | 8.4 | 9.1 | 12.0 | 14.6 |
| Propylene | 23.9 | 25.0 | 25.5 | 24.0 |
| Butenes | 10.1 | 9.9 | 10.6 | 10.4 |
| Aromatics | 21.7 | 19.6 | 17.5 | 35.5 |
| $C_1$–$C_4$ Light Saturates | 3.4 | 1.9 | 2.9 | 2.7 |

As shown in Table 2, ethylene yield was 14.6 wt % while propylene yield was 24.0 wt % when 1, 5 hexadiene was cracked neat over ZCAT40 at 593° C. Aromatics yield was very high at 35.5 wt % in neat cracking of 1, 5 hexadiene. Unexpectedly, it was found that there is a minimum in aromatics yield at 10–20 wt % 1,5 hexadiene in the feed. Further the total light olefin yields (12.0 ethylene and 25.5 wt % propylene) obtained with 21.3 wt % 1, 5 hexadiene in the feed are nearly 6 wt % higher than the total light olefins obtained in cracking of LCN without diolefins added.

EXAMPLE 2

A series of runs in a bench reactor were conducted on a light virgin naphtha spiked with 1,5-hexadiene, unspiked LCN, and unspiked LVN. All runs were conducted at 650° C., 1.2 $Hr^{-1}$ WHSV over a fixed bed packed with ZCAT40, which is a commercially available ZSM-5 catalyst from Intercat Inc. of Sea Grit, N.J. Prior to laboratory tests, ZCAT40 was steamed with 100% steam, at 816° C. and 1 atmosphere for 16 hours to age the catalyst. The effluent stream was analyzed by on-line gas chromatography. A capillary column having a length of 50 m packed with crosslinked methyl silicone gum was used for the analysis. The GC used was a dual FID Hewlette Packard Model 5880. Table 3 shows yields at comparable intervals during the runs.

TABLE 3

Diolefin effect on an LVN Stream Over Time

| LCN FEED | | | LVN FEED | | | LVN + 10% 1,5 Hexadiene | | |
|---|---|---|---|---|---|---|---|---|
| Hours on Feed | Ethene Wt.% | Propene Wt.% | Hours on Feed | Ethene Wt.% | Propene Wt.% | Hours on Feed | Ethene Wt.% | Propene Wt.% |
| 4.8 | 15.9 | 23.2 | 5.2 | 12.6 | 25.0 | 5.3 | 15.2 | 28.6 |
| 9.6 | 15.2 | 26.4 | 10.1 | 12.6 | 24.8 | 10.3 | 14.6 | 29.2 |
| 19.0 | 14.3 | 24.7 | 19.9 | 12.7 | 24.8 | 20.3 | 13.9 | 28.3 |
| 23.7 | 13.1 | 22.9 | 24.9 | 12.1 | 24.2 | 25.3 | 14.5 | 28.4 |
| 28.4 | 11.8 | 21.2 | 29.7 | 12.4 | 24.0 | 30.3 | 14.3 | 28.5 |
| 33.2 | 8.8 | 16.5 | 34.7 | 11.9 | 23.8 | 35.3 | 14.0 | 27.6 |
| 37.8 | 8.4 | 13.4 | 37.2 | 11.9 | 23.4 | 40.3 | 14.1 | 27.7 |
| 42.6 | 5.7 | 7.4 | 44.5 | 11.7 | 23.3 | 45.3 | 12.2 | 25.1 |
| | | | 54.4 | 11.3 | 22.5 | 55.3 | 13.4 | 27.0 |
| | | | 66.7 | 10.6 | 20.6 | 65.3 | 12.5 | 25.2 |

TABLE 3-continued

| Diolefin effect on an LVN Stream Over Time | | | | | | | | |
|---|---|---|---|---|---|---|---|---|
| LCN FEED | | | LVN FEED | | | LVN + 10% 1,5 Hexadiene | | |
| Hours on Feed | Ethene Wt.% | Propene Wt.% | Hours on Feed | Ethene Wt.% | Propene Wt.% | Hours on Feed | Ethene Wt.% | Propene Wt.% |
| | | | 76.2 | 10.0 | 19.5 | 75.3 | 9.6 | 19.9 |
| | | | 86.4 | 9.5 | 18.6 | 85.3 | 7.9 | 17.7 |
| | | | 96.2 | 9.2 | 17.9 | 95.3 | 6.6 | 15.5 |

The preceding data show that yields of ethylene and propylene are initially higher for LCN than for LVN but LCN alone rapidly fouls the catalyst and yields decrease. LVN starts with initially lower yields but maintains higher levels with much less rapid loss of catalyst activity. The beneficial effect of the invention is dramatically illustrated by the improvement over LVN initial yields while avoiding the rapid loss of catalyst activity seen with LCN feed alone.

The preceding examples are presented to illustrate the invention and not as limitations. There are many variations on the invention that will be apparent to those skilled in the art. The invention is defined and limited by the claims set out below.

We claim:

1. A process for improving the conversion of a hydrocarbon feedstock to light olefins comprising contacting a hydrocarbon feedstock containing at least one diolefin, in a concentration sufficient to increase conversion of the feedstock to light olefins, with a cracking catalyst comprising an acidic zeolite; and cracking the hydrocarbon feedstock to form light olefins.

2. The process of claim 1 wherein the cracking catalyst comprises a zeolite having a silica to alumina molar ratio within the range of about 2.0:1 to 2000:1.

3. The process of claim 1 wherein the zeolite is selected from the group consisting of faujasite, chabazite, erionite, mordenite, offretite, gmelinite, analcite, ferrierite, heulandite, mazzite, phillipsite, ZSM-5, ZSM-11, ZSM-18, ZSM-22, ZSM-25, gallium silicate, zeolite beta, zeolite rho, ZK5, titanosilicate, ferrosilicate, and borosilicate.

4. The process of claim 1 wherein the diolefin is present in the range of 2 to 50 wt %.

5. The process of claim 1 wherein the diolefin is present in the range of 10 to 20 wt %.

6. The process of claim 1 wherein the diolefin is present at about 10 wt %.

7. The process of claim 1 wherein the feedstock is selected from the group consisting of steam cracked naphtha, butenes, pentylenes, coker naphtha, light cat naphtha and light virgin naphtha.

8. The process of claim 1 wherein the catalyst is contacted at a reaction temperature within the range of 500° C. to 750° C. and the feedstock flows at a weight hourly space velocity in the range of 0.1 $Hr^{-1}$ WHSV to 100 $Hr^{-1}$ WHSV.

9. The process of claim 8 wherein the catalyst is contacted at a reaction temperature within the range of 550° C. to 700° C.

10. The process of claim 8 wherein the feedstock flow is in the range of 1 $Hr^{-1}$ WHSV to 50 $Hr^{-1}$ HSV.

11. The process of claim 8 wherein the catalyst is contacted at a reaction temperature in the range of 575° C. to 625° C.

12. The process of claim 8 wherein the feedstock flow is in the range of 1 $Hr^{-1}$ WHSV to 30 $Hr^{-1}$ WHSV.

13. The process according to claim 1 wherein the diolefin is a hydrocarbon of 2 to 20 carbons.

14. The process of claim 1 wherein the diolefin is a hydrocarbon of 2 to 14 carbons.

15. The process of claim 1 wherein the diolefin is a hydrocarbon of 2 to 10 carbons.

16. In a process for increasing the yield of ethylene and propylene in a catalytic cracking process wherein a feedstock including a hydrocarbon selected from the group consisting of steam cracked naphtha, butenes, pentylenes, coker naphtha, light cat naphtha, light virgin naphtha is contacted with a zeolite catalyst to crack the hydrocarbon to form ethylene and propylene, the improvement which comprises adding at least one diolefin of 2 to 20 carbons to the feedstock to form a mixture comprising from 2 to 50 weight percent of the diolefin.

17. The process of claim 16 wherein the cracking catalyst is a zeolite having a silica-alumina ratio within the range of about 2:1 to 2000:1.

18. The process of claim 16 wherein the zeolite is selected from the group consisting of faujasite, chabazite, erionite, mordenite, offretite, gmelinite, analcite, ferrierite, heulandite, mazzite, phillipsite, ZSM-5, ZSM-11, ZSM-18, ZSM-22, ZSM-25, gallium silicate, zeolite beta, zeolite rho, ZK5, titanosilicate, ferrosilicate; and borosilicate.

19. The process of claim 16 wherein the catalyst is contacted at an entry temperature within the range of about 500° C. to about 750° C. and the feedstock flows at a weight hourly space velocity in the range of about 0.1 $Hr^{-1}$ WHSV to about 100 $Hr^{-1}$ WHSV.

20. The process of claim 16 wherein the diolefin is a hydrocarbon of 2 to 14 carbons.

21. The process of claim 16 wherein the diolefin is a hydrocarbon of 2 to 10 carbons.

22. A process for improving the conversion of a hydrocarbon feedstock to ethylene or propylene comprising:

(1) mixing a hydrocarbon feedstock with a light olefin yield improving concentration of diolefin to form a mixture;

(2) contacting the mixture with a cracking catalyst comprising an acidic zeolite; and (3) cracking the hydrocarbon feedstock to ethylene or propylene.

23. The process of claim 22 wherein the cracking catalyst comprises a zeolite having a silica-alumina ratio within the range of about 2:1 to 2000:1.

24. The process of claim 22 wherein the zeolite is selected from the group consisting of faujasite, chabazite, erionite, mordenite, offretite, gmelinite, analcite, ferrierite, heulandite, mazzite, phillipsite, ZSM-5, ZSM-11, ZSM-18, ZSM-22, ZSM-25, gallium silicate zeolite, zeolite beta, zeolite rho, ZK5, titanosilicate, ferrosilicate, and borosilicate zeolites.

25. The process of claim 22 wherein the feedstock is selected from the group consisting of steam cracked naphtha, butylenes, pentylenes, coker naphtha, light cat naphtha, and light virgin naphtha.

26. The process of claim 22 wherein the catalyst is contacted at an entry temperature within the range of 500° C. to 750° C. and the feedstock flows at a weight hourly space velocity in the range of 0.1 $Hr^{-1}$ WHSV to 100 $Hr^{-1}$ WHSV.

27. The process of claim 22 wherein the catalyst is contacted at an entry temperature within the range of 550° C. to 700° C.

28. The process of claim 22 wherein the feedstock flow is in the range of 1 $Hr^{-1}$ WHSV to 50 $Hr^{-1}$ WHSV.

29. The process of claim 22 wherein the catalyst is contacted at an entry temperature in the range of 575° C. to 625° C.

30. The process of claim 22 wherein the feedstock flow is in the range of 1 $Hr^{-1}$ WHSV to 30 $Hr^{-1}$ WHSV.

31. The process according to claim 22 wherein the diolefin is a hydrocarbon of 2 to 20 carbons.

32. The process of claim 22 wherein the diolefin is a hydrocarbon of 2 to 14 carbons.

33. The process of claim 22 wherein the diolefin is a hydrocarbon of 2 to 10 carbons.

34. The process of claim 22 wherein the diolefin is present in the range of 2 to 50 wt %.

35. The process of claim 22 wherein the diolefin is present in the range of 10 to 20 wt %.

36. A process for improving the conversion of light virgin naphtha to ethylene or propylene comprising:

(1) mixing the light virgin naphtha with a light olefin yield improving concentration of diolefin to form a mixture;

(2) contacting the mixture with a cracking catalyst comprising an acidic zeolite in a reactor selected from the group consisting of a fixed bed reactor or a moving bed reactor; and (3) cracking the mixture to convert the light virgin naphtha to ethylene or propylene.

37. The process of claim 36 wherein the cracking catalyst comprises a zeolite having a silica-alumina ratio within the range of about 2:1 to 2000:1.

38. The process of claim 36 wherein the zeolite is selected from the group consisting of faujasite, chabazite, erionite, mordenite, offretite, gmelinite, analcite, ferrierite, heulandite, mazzite, phillipsite, ZSM-5, ZSM-11, ZSM-18, ZSM-22, ZSM-25, gallium silicate zeolite, zeolite beta, zeolite rho, ZK5, titanosilicate, ferrosilicate, and borosilicate zeolites.

39. The process of claim 36 wherein the catalyst is contacted at an entry temperature within the range of 500° C. to 750° C. and the light virgin naphtha flows at a weight hourly space in the range of 0.1 WHSV to 30 WHSV.

40. The process of claim 36 wherein the catalyst is contacted at an entry temperature within the range of 550° C. to 700° C.

41. The process of claim 36 wherein the catalyst is contacted at an entry temperature in the range of 575° C. to 625° C.

42. The process of claim 36 wherein the diolefin is a hydrocarbon of 2 to 14 carbons.

43. The process of claim 36 wherein the diolefin is a hydrocarbon of 2 to 10 carbons.

44. The process of claim 36 wherein the diolefin is present in the range of 2 to 50 wt %.

45. The process of claim 36 wherein the diolefin is present in the range of 10 to 20 wt %.

* * * * *